US006372696B1

(12) United States Patent
Tipton

(10) Patent No.: US 6,372,696 B1
(45) Date of Patent: Apr. 16, 2002

(54) TRACTION FLUID FORMULATION

(75) Inventor: Craig D. Tipton, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/436,409

(22) Filed: Nov. 9, 1999

(51) Int. Cl.[7] ..... C10M 105/04

(52) U.S. Cl. ..... 508/110; 508/287; 508/391; 525/1; 525/16; 525/20; 252/73

(58) Field of Search ..... 508/110; 585/1, 585/16, 20

(56) References Cited

U.S. PATENT DOCUMENTS

| | | | | | |
|---|---|---|---|---|---|
| 3,440,894 | A | | 4/1969 | Hammann | 74/200 |
| 3,803,037 | A | | 4/1974 | Wygant | 252/32.7 |
| 3,925,217 | A | | 12/1975 | Green et al. | 252/52 |
| 3,966,624 | A | | 6/1976 | Duling et al. | 252/52 |
| 3,972,243 | A | | 8/1976 | Driscoll et al. | 74/200 |
| 3,975,278 | A | | 8/1976 | Wygant | 252/59 |
| 3,994,816 | A | * | 11/1976 | Wygant | 252/73 |
| 4,046,703 | A | * | 9/1977 | Duling et al. | 252/73 |
| 4,081,489 | A | * | 3/1978 | Bateman | 260/668 F |
| 4,190,546 | A | * | 2/1980 | Kulik et al. | 252/49.6 |
| 4,329,529 | A | * | 5/1982 | Nambu | 585/20 |
| 4,654,403 | A | | 3/1987 | Tipton | 525/194 |
| 4,774,013 | A | | 9/1988 | Abe et al. | 252/73 |
| 4,840,745 | A | | 6/1989 | Tsubouchi et al. | 252/73 |
| 4,871,476 | A | | 10/1989 | Youshimura et al. | 252/565 |
| 4,889,649 | A | | 12/1989 | Murai et al. | 252/73 |
| 4,922,047 | A | * | 5/1990 | Chen et al. | 585/12 |
| 4,975,215 | A | | 12/1990 | Abe et al. | 252/73 |
| 5,039,440 | A | * | 8/1991 | Yoshimura et al. | 252/79 |
| 5,043,497 | A | | 8/1991 | Muraki et al. | 585/20 |
| 5,075,024 | A | * | 12/1991 | Yoshimura et al. | 252/79 |
| 5,126,065 | A | | 6/1992 | Tsubouchi et al. | 252/56 |
| 5,133,886 | A | | 7/1992 | Hata | 252/25 |
| 5,198,129 | A | | 3/1993 | Hata | 252/32.7 |
| 5,259,978 | A | * | 11/1993 | Yoshimura et al. | 252/79 |
| 5,306,851 | A | * | 4/1994 | Wu et al. | 585/22 |
| 5,336,827 | A | | 8/1994 | Ohno et al. | 585/502 |
| 5,344,582 | A | * | 9/1994 | Umemoto et al. | 252/9 |
| 5,422,027 | A | | 6/1995 | Abe et al. | 252/73 |
| 5,460,741 | A | | 10/1995 | Hata et al. | 252/51.5 |
| 5,858,929 | A | | 1/1999 | Sumiejski et al. | 508/162 |
| 6,242,393 | B1 | | 6/2001 | Ishida et al. | 508/462 |

FOREIGN PATENT DOCUMENTS

| | | | |
|---|---|---|---|
| EP | 275 313 A | 12/1987 | 111/4 |
| EP | 275 315 A | 7/1988 | |
| EP | 295 304 | 12/1988 | 105/32 |
| EP | 328 642 | 8/1989 | 111/4 |
| EP | 0 949 319 | 10/1999 | 105/2 |
| GB | 2 224 287 | 3/1990 | |

OTHER PUBLICATIONS

Smalheer et al, "Lubricant Additives", p. 1–11, 1967.*

SAE Technical Paper 1999–01–3614, Huston et al., "Shifting from Automatic to Continuously Variable Transmissions: A Look at Fluid Technology Requirements," Oct. 27, 1999.

SAE Techincal Paper Series 902144, Watts et al., "Formulating Automatic Transmission Fluids with Improved Low Temperature Fluidity," Oct., 1990/.

* cited by examiner

*Primary Examiner*—Ellen M. McAvoy
(74) *Attorney, Agent, or Firm*—David M. Shold; Michael F. Esposito

(57) ABSTRACT

A traction fluid useful in automotive power transmitting equipment includes a base fluid of polymers of at least one olefin which contains 3 to 5 carbon atoms, hydrocarbon molecules containing non-aromatic cyclic moieties, or mixtures thereof; a low-temperature viscosity control agent selected from the group consisting of oligomers or polymers of linear alpha olefins of at least 8 carbon atoms, naphthenic oils, synthetic ester oils, polyether oils, and mixtures thereof, in an amount sufficient to reduce the low temperature viscosity of the traction fluid; and an additive package including dispersants, detergents, or mixtures thereof, along with other optional additive components.

37 Claims, No Drawings

TRACTION FLUID FORMULATION

BACKGROUND OF THE INVENTION

The present invention relates to traction fluids and their use in lubricating power transmitting equipment, especially, a traction drive, and more specifically, an automotive traction drive.

Traction drives are devices in which power or torque is transmitted from an input element to an output element through nominal point or line contact, typically with a rolling action, by virtue of the traction between the contacting elements. Traction drives can be generally used in automotive or industrial machinery for transmitting power between rotating members. They can be used as automatic transmissions and are particularly suitable as a form of continuously variable automatic transmission for use in automobile drivetrains and other applications.

While the working elements of a traction drive are sometimes spoken of as being in contact, it is generally accepted that a fluid film must be provided therebetween. Thus, rather than metal-to-metal rolling contact, a film of fluid is introduced into the load zone, and power is transmitted by shearing of the film, which may become very viscous due to the high pressure at the contact area. The nature and properties of the fluid, therefore, will determine to a large extent the performance and capacity of the traction drive. Traction fluids will preferably have a high shear resistance (often measured as "traction coefficient") to maximize the power transmission performance. Low viscosity, particularly at low temperatures, is also desirable for efficient operation under cold conditions. The fluid should ideally also exhibit good lubricating properties for and compatibility with other components of the traction drive. Such fluids also serve to remove heat and prevent wear at the contact surfaces and to lubricate bearings and other moving parts associated with the drive.

Traction fluids based on a variety of base fluids are known. For example, U.S. Pat. No. 5,043,497, Muraki et al., Aug. 27, 1991, discloses a lubricating oil for a traction drive, mainly composed of a naphthenic hydrocarbon having 19 carbon atoms comprising two substituted cyclohexane rings linked by a methylene group. Additives for ordinary lubricating oils such as antioxidants, agents for increasing the viscosity index, corrosion inhibitors, detergents, defoamers, and so forth are added as necessary. Calcium sulfonate is disclosed as a detergent.

U.S. Pat. No. 3,975,278, Wygant, Aug. 17, 1976, discloses hydrogenated dimers of a-alkyl styrene, which are useful as tractive fluids. Additives such as VI improvers, antioxidants, antiwear agents, corrosion inhibitors, dispersants, and dyes can be included.

U.S. Pat. No. 3,966,624, Duling et al., Jun. 29, 1976, discloses a blended traction fluid containing hydrogenated polyolefin and an adamantane ether. The lubricant described can contain other oils and additives, e.g., a sludge dispersant. An especially useful additive, combining detergency, corrosion inhibition and friction improvement at high speeds, is a Mg, Ca or Ba salt (especially a super-based salt) of certain weak acids.

A variety of additive formulation for use in transmission fluids and other functional fluids are generally known. For instance, U.S. Pat. No. 5,858,929, Sumiejski et al., Jan. 12, 1999, equivalent to European Patent publication 747,464, published Jun. 6, 1996, discloses a composition for use in lubricants and functional fluids to provide improved anti-shudder and shudder durability properties to an automatic transmission. The composition comprises alkoxylated fatty amines as well as a mixture of other friction modifiers. Preferred compositions include alkoxylated fatty amines, other friction modifiers, antioxidants, overbased metal organic acid, dispersants, viscosity index improver and/or dispersant-viscosity modifier, extreme pressure agent, seal swell agent, and 85% phosphoric acid. The base oils of lubricating viscosity include liquid petroleum oils and solvent treated or acid treated mineral lubricating oils of the paraffinic, naphthenic or mixed naphthenic-paraffinic types.

The present invention solves the problem of providing a fluid for a traction drive with a sufficiently high traction coefficient to maintain the efficiency of the unit, while at the same time providing a low enough viscosity that the unit will operate at ambient temperatures in cold climates. Additionally, the presence of suitable additives provides lubrication and compatibility of the fluid with the operation of conventional clutches, seals, and gears which may be present in the traction drive unit. The traction fluids of the present invention can also be used in other types of power transmission devices such as continuously variable transmissions of the push-belt type. Push-belt continuously variable transmissions are described in U.S. Pat. No. 5,750,477.

SUMMARY OF THE INVENTION

The present invention provides a traction fluid useful in automotive power transmitting equipment, comprising (a) a major amount of a base fluid selected from the group consisting of polymers of at least one olefin which contains 3 to 5 carbon atoms, hydrocarbon or ester molecules containing non-aromatic cyclic moieties, and mixtures thereof; (b) a low-temperature viscosity control agent selected from the group consisting of oligomers or polymers of linear alpha olefins of at least 8 carbon atoms, naphthenic oils, synthetic ester oils, polyether oils, and mixtures thereof, in an amount sufficient to reduce the viscosity at −40° C. of said traction fluid; and (c) an additive selected from the group consisting of dispersants, detergents, and mixtures thereof, in an amount sufficient to improve the clutch friction durability performance of said traction fluid.

The present invention also provides a method of lubricating a power transmission apparatus such as a traction drive, comprising employing therein the above-described traction fluid.

DETAILED DESCRIPTION OF THE INVENTION

Various preferred features and embodiments will be described below by way of non-limiting illustration.

The first, and major component of the traction fluids of the present invention is a base fluid or base oil. Certain types of base fluids are particularly suited for use in traction fluids because of their inherently good (high) traction coefficients. Two types of base fluids which are particularly suitable are (1) polymers of at least one olefin which contains 3 to 5 carbon atoms, and (2) hydrocarbon molecules containing non-aromatic cyclic moieties. Mixtures of these types of materials can also be used. For suitable performance, the base fluid should preferably have a viscosity of greater than $2.5\times10^{-6}$ $m^2/s$ (2.5 cSt) at 100° C. (ASTM D-445), and more preferably a viscosity of at least $3.0\times10^{-6}$ $m^2/s$ (3.0 cSt) or $3.5\times10^{-6}$ $m^2/s$ (3.5 cSt), typically up to $8.0\times10^{-6}$ $m^2/s$ (8.0 cSt) or $7.0\times10^{-6}$ $m^2/s$ (7.0 cSt) or $6.0\times10^{-6}$ $m^2/s$ (6.0 cSt) at 100° C.

Suitable base fluids of type (1) include polymers of branched olefins, preferably isobutylene, particularly those having a number average molecular weight of 180 to 2000, preferably 200 to 1000 or to 700. The polymer is preferably hydrogenated to remove any residual unsaturation. Such materials and their preparation are well known and are described, for instance, in U.S. Pat. No. 3,966,624, as component A, described particularly in column 12 line 32 through column 16 line 11.

Suitable base fluids of type (2) include a wide variety of cyclic-containing hydrocarbon molecules. Examples of these include di(cyclohexyl)alkanes, cyclohexyl hydrindans and adamantane compounds, as described in U.S. Pat. No. 3,966,624; esters of cyclohexanol and cylohexanecarboxylic acid, as described in U.S. Pat. No. 4,871,476; decalin, cycohexyldecalin, alkyl-substituted decalin, alkyl-substituted cyclohexyldecalin, and mixtures thereof, as described in U.S. Pat. No. 3,803,037; various materials having two cyclohexane rings linked by a methylene group described in U.S. Pat. No. 5,043,497; various hydrocarbon compounds having a bicyclooctane skeleton described in U.S. Pat. No. 5,422,027; hydrogenated products of dimers, trimers, or tetramers of norbornanes and/or norbornenes described in U.S. Pat. No. 5,126,065; hydrogenated dimers, trimers, or polymers of cyclic monoterpenoid monomers described in U.S. Pat. No. 4,975,215; various ter-cyclohexyl compounds disclosed in U.S. Pat. No. 5,850,745; perhydrofluorene derivatives disclosed in U.S. Pat. No. 4,774,013; and preferably linear dimers of hydrogenated α-alkyl styrene, as described in U.S. Pat. No. 3,975,278. Any of the above materials may be used in a hydrogenated form, to assure the removal of carbon unsaturation; indeed, certain hydrogenated styrene derivatives (or cyclohexane derivatives) are inherently hydrogenated species. However, aromatic cyclic structures such as those derived from styrene may also be present in the base fluid, since aromatic cyclic structures are generally considered to be less deleterious than olefinic unsaturation.

The preferred materials for option (2) of the base fluid are predominantly linear dimers of hydrogenated α-alkyl styrene. These dimers are said to be predominantly linear, in contrast to the cyclic dimers which represent another possible structure. Such preferred materials can be represented by the general structure

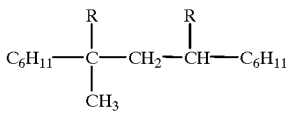

wherein each R is an alkyl group of 1 to 4 carbon atoms and $C_6H_{11}$ represents a cyclohexyl group. Such materials and their preparation are described in detail in U.S. Pat. No. 3,975,278. Indeed, the base fluid for the present composition preferably contains a major proportion of compounds represented as shown above.

The amount of the base fluid is a major amount of the traction fluid. By "a major amount" is meant at least 50 percent by weight of the fluid. Preferably the base fluid comprises 70 to 95 percent by weight of the fluid, more preferably 75 to 90 percent by weight, and still more preferably 80 to 85 percent by weight.

A second component of the present traction fluids is a low-temperature viscosity control agent. The low-temperature viscosity control agent (which is to be distinguished from a viscosity index modifier, an optional component described below) is selected from among a variety of materials which are known to be useful for this purpose. The low-temperature viscosity control agent is selected from (a) oligomers or polymers of linear alpha olefins of at least 8 carbon atoms, (b) naphthenic oils, (c) synthetic ester oils, (d) polyether oils, and mixtures thereof. These materials are distinguishable from the base fluids, described above, in that they are generally lower viscosity materials than the base fluid, typically exhibiting a viscosity of up to or less than $2.5\times10^{-6}$ $m^2/s$ (2.5 cSt), preferably 1.5 to 2.5, or 1.8 to $2.3\times10^{-6}$ m2/s (1.5 to 2.5 or 1.8 to 2.3 cSt) at 100° C. These are also materials which typically retain a measure of mobility at low temperatures (e.g., −40° C.) and can serve to reduce the low temperature viscosity of fluids to which they are added. Materials which are of unduly high viscosity or which do not retain mobility at low temperatures do not effectively serve as low-temperature viscosity control agents. Determination of viscosity and low temperature mobility is well within the abilities of those skilled in the art.

Polymers and oligomers of linear α-olefins are well known items of commerce. A typical commercial material is Ethylflo™ 162, a $2\times10^{-6}$ $m^2/s$ (2 cSt) poly α-olefin product of Ethyl Corporation Preferred materials are those oligomers or polymers of α-olefins containing 8 to 16 carbon atoms, and preferably 10 to 12 carbon atoms. Such materials do not contain a significant fraction of α-olefin monomers of fewer than 8 carbon atoms, that is, less than 5 percent by weight, preferably less than 1 percent by weight, and more preferably substantially no such monomers. Thus common materials such as ethylene-octene polymers, where the ethylene predominates, are excluded from use as low temperature viscosity modifiers in the materials of the present invention. The description "oligomers or polymers" is used since generally low molecular weight materials are desired, and there is otherwise no clear demarcation between an oligomer and a polymer. Materials as low as dimers (a degree of polymerization of 2) are included. Suitable materials for the present invention typically have a molecular weight range of 100 to 1000, preferably 150 to 600, and most preferably 250 to 500 or 250 to 400.

Naphthenic oils are well known items of commerce, commonly derived from petroleum. Preferred materials are hydrogenated naphthenic oils, which are also well known. Examples include Hydrocal™38, from Calumet Lubricants Company and 40 Pale Oil™ from Diamond Shamrock. Synthetic ester oils suitable for use as low temperature viscosity control agents include esters of polyhydroxy compounds and predominantly monocarboxylic acylating agents; esters of predominantly monohydroxy compounds and polycarboxylic acylating agents; esters of monohydroxy compounds and monocarboxylic acylating agents, and mixtures of the foregoing types. The prefix "poly" in this context indicates at least two hydroxy groups or carboxylic groups, as the case may be. The molecular weight of the esters (as of any of the viscosity control agents) should be sufficiently high that the materials are not objectionably volatile so as to be subject to significant evaporative loss under operating conditions, while retaining the above-described viscosities. Certain synthetic ester oils and their methods of preparation are disclosed in PCT publication WO 91/13133. Synthetic ester oils are available as Emery™ synthetic lubricant basestocks, from Henkel Corporation and as Emkarate™ lubricant basestocks from Imperial Chemical Industries PLC.

Polyether oils suitable for use as low temperature viscosity control agent include polyalkylene oxides, and in particular, polyethylene oxides, polypropylene oxides, polybutylene oxides, and mixtures thereof. The polyether oil will typically have a molecular weight in the ranges suitable for maintaining an appropriate viscosity and non-volatility. Such materials are also well known items of commerce and are available as Emkarox™ polyalkylene glycols from Imperial Chemical Industries PLC.

As is the case with the base fluid, the low temperature viscosity control agent is often a hydrogenated material. Each of these components will preferably contain fewer than 20%, fewer than 15%, or more preferably fewer than 10% molecules containing carbon-carbon unsaturation, and in the most preferred case will be substantially free from carbon-carbon unsaturation, that is to say, retaining at most a low level of unsaturation which does not measurably or significantly affect its performance.

The amount of the low temperature viscosity control agent in the traction fluid is preferably that amount suitable to provide a viscosity at −40° C. of less than or equal to 100 Pa·s (100,000 cP), such as 2–100 Pa·s (2,000 to 100,000 cP), preferably 5 to 80 or 70 Pas (5,000 to 80,000 or 70,000 cP), and more preferably 10 to 50 Pa·s (10,000 to 50,000 cP). Otherwise expressed, the amount of low temperature viscosity control agent should preferably 1 to 20 percent by weight of the traction fluid, preferably 3 to 15, and more preferably 5 to 10 percent by weight.

In addition to the base fluid and low-temperature viscosity control agent, the traction fluid of the present invention will contain an additive which includes at least one dispersant, or at least one detergent, or mixtures thereof. Dispersants and detergents are extremely well-known and commonly used materials in the field of lubrication. The amount of such additive is that which is sufficient to improve the clutch friction durability performance of the traction fluid, compared to the performance in the absence of such additive. The amount of this additive (including the detergent and the dispersant, if both are present) is preferably up to 20 percent by weight of the traction fluid, preferably 5 to 15 percent by weight.

The dispersants useful as a component in the present fluids include acylated amines, carboxylic esters, Mannich reaction products, hydrocarbyl substituted amines, and mixtures thereof.

Acylated amine dispersants include reaction products of one or more carboxylic acylating agent and one or more amine. The carboxylic acylating agents include $C_{8-30}$ fatty acids, $C_{14-20}$ isoaliphatic acids, $C_{18-44}$ dimer acids, addition dicarboxylic acids, trimer acids, addition tricarboxylic acids, and hydrocarbyl substituted carboxylic acylating agents. Dimer acids are described in U.S. Pat. Nos. 2,482,760, 2,482,761, 2,731,481, 2,793,219, 2,964,545, 2,978,468, 3,157,681, and 3,256,304. The addition carboxylic acylating agents are addition (4+2 and 2+2) products of an unsaturated fatty acid with one or more unsaturated carboxylic reagents. These acids are taught in U.S. Pat. No. 2,444,328. In another embodiment, the carboxylic acylating agent is a hydrocarbyl substituted carboxylic acylating agent. The hydrocarbyl substituted carboxylic acylating agents are prepared by a reaction of one or more of olefins or polyalkenes with one or more of unsaturated carboxylic agents, such as itaconic, citraconic, or maleic acylating agents, typically at a temperature of 160°, or 185° C. up to 240° C., or to 210° C. Maleic acylating agents are the preferred unsaturated acylating agent. The procedures for preparing the acylating agents are well known to those skilled in the art and have been described for example in U.S. Pat. No. 3,412,111; and Ben et al, "The Ene Reaction of Maleic Anhydride With Alkenes", J. C. S. Perkin II (1977), pages 535–537.

The amines which react with the acylating agents may be known amines, preferably a polyamine, such as an alkylenepolyamine or a condensed polyamine. Polyamines can be aliphatic, cycloaliphatic, heterocyclic or aromatic., Examples of the polyamines include alkylene polyamines, hydroxy containing polyamines, arylpolyamines, and heterocyclic polyamines.

Alkylene polyamines are represented by the formula

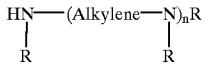

wherein n has an average value from 1 or 2 to 10, or to 7, or to 5, and the "Alkylene" group has from 1 or 2 to 10, or to 6, or to 4 carbon atoms. Each R is independently hydrogen, or an aliphatic or hydroxy-substituted aliphatic group of up to 30 carbon atoms. Acylated amines, their intermediates and methods for preparing the same are described in U.S. Pat. Nos. 3,219,666; 4,234,435; 4,952,328; 4,938,881; 4,957,649; 4,904,401; and 5,053,152.

In another embodiment, the dispersant can be a carboxylic ester. The carboxylic ester is prepared by reacting at least one or more carboxylic acylating agents, preferably a hydrocarbyl substituted carboxylic acylating agent, with at least one organic hydroky compound and optionally an amine. The hydroxy compound may be an alcohol or a hydroxy containing amine.

The alcohols may contain non-hydrocarbon substituents of a type which do not interfere with the reaction of the alcohols with the acid (or corresponding acylating agent) to form the ester. In one embodiment, the alcohols can be polyhydric alcohols, such as alkylene polyols. Preferably, such polyhydric alcohols contain from 2 to 40 carbon atoms, more preferably 2 to 20; and from 2 to 10 hydroxyl groups, more preferably 2 to 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; cyclohexane diol; erythritol; and pentaerythritols, including di- and tripentaerythritol; preferably, diethylene glycol, triethylene glycol, glycerol, sorbitol, pentaerythritol and dipentaerythritol. Commercially available polyoxyalkylene alcohol demulsifiers can also be employed as the alcohol component.

The carboxylic ester dispersants may be prepared by any of several known methods. The method which is preferred because of convenience and the superior properties of the esters it produces, involves the reaction of the carboxylic acylating agents described above with one or more alcohol or phenol in ratios from 0.5 equivalent to 4 equivalents of hydroxy compound per equivalent of acylating agent. The preparation of useful carboxylic ester dispersant is described in U.S. Pat. Nos. 3,522,179 and 4,234,435.

The carboxylic ester dispersants may be further reacted with at least one of the above described amines and preferably at least one of the above described polyamines, such as a polyethylenepolyamine, condensed polyamine, or a heterocyclic amine, such as aminopropylmopholine. The amine is added in an amount sufficient to neutralize any non-esterified carboxyl groups. In one embodiment, the carboxylic ester dispersants are prepared by reacting from 1 to 2 equivalents, or from 1.0 to 1.8 equivalents of hydroxy compounds, and up to 0.3 equivalent, or from 0.02 to 0.25 equivalent of polyamine per equivalent of acylating agent. The carboxylic acid acylating agent may be reacted simultaneously with both the hydroxy compound and the amine. There is generally at least 0.01 equivalent of the alcohol and at least 0.01 equivalent of the amine although he total amount of equivalents of the combination should be at least 0.5 equivalent per equivalent of acylating agent. These carboxylic ester dispersant compositions are known in the art, and the preparation of a number of these derivatives is described in, for example, U.S. Pat. Nos. 3,957,854 and 4,234,435.

In another embodiment, the dispersant may also be a hydrocarbyl-substituted amine. These hydrocarbyl-substituted,amines are well known to those skilled in the art. These amines and methods for their preparation are disclosed in U.S. Pat. Nos. 3,275,554; 3,438,757; 3,454,555; 3,565,804; 3,755,433; and 3,822,289. Typically, hydrocarbyl substituted amines are prepared by reacting olefins and olefin polymers, including the above polyalkenes and halogenated derivatives thereof, with amines (mono- or polyamines). The amines may be any of the amines described above, preferably an alkylenepolyamine. Examples of hydrocarbyl substituted amines include ethylenepolyamines such as diethylenetriamine; poly(propylene) amine; N,N-dimethyl-N-poly(ethylene/propylene)-amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)-ethylenediamine; N-poly(propylene)trimethylenediamine; N-poly(butene)-diethylenetriamine; N',N"-poly(butene) tetraethylenepentamine; and N,N-dimethyl-N'-poly (propylene)-1,3-propylenediamine.

In another embodiment, the dispersant may also be a Mannich dispersant. Mannich dispersants are generally formed by the reaction of at least one aldehyde, such as formaldehyde and paraformaldehyde, at least one of the above described amines, preferably a polyamine, such as a polyalkylenepolyamine, and at least one alkyl substituted hydroxyaromatic compound. The amounts of the reagents is such that the molar ratio of hydroxyaromatic compound to formaldehyde to amine is in the range from (1:1:1) to (1:3:3). The hydroxyaromatic compound is generally an alkyl substituted hydroxyaromatic compound. This term includes the above described phenols. The hydroxyaromatic compounds are those substituted with at least one, and preferably not more than two, aliphatic or alicyclic groups having from 6 to 400, or from 30 to 300, or from 50 to 200 carbon atoms. These groups may be derived from one or more of the above described olefins or polyalkenes. In one embodiment, the hydroxyaromatic compound is a phenol substituted with an aliphatic or alicyclic hydrocarbon-based group having an $\overline{M}_n$ of 420 to 10,000. Mannich dispersants are described in the following patents: U.S. Pat. No. 3,980,569; U.S. Pat. No. 3,877,899; and U.S. Pat. No. 4,454,059.

The dispersant can also be a dispersant which has been treated or reacted with any of a variety of common agents. In one embodiment, the boron compound is a borated dispersant. Typically, a borated dispersant contains 0.1% to 5%, or 0.5% to 4%, or 0.7% to 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. Borated dispersant are prepared by reaction of one or more dispersant with one or more boron compounds such as an alkali or mixed alkali metal and alkaline earth metal borate. These metal borates are generally a hydrated particulate metal borate which are known in the art. Alkali metal borates include mixed alkali and alkaline metal borates. These metal borates are available commercially.

Dispersants can also be treated by or reacted with other agents to produce well-known variants. Such agent include sulfurizing agents such as elemental sulfur or $CS_2$ and dimercaptothiadizoles. Reactions of dispersants with a dimer-capto-thiadiazole is taught, for example, in U.S. Pat. No. 4,136,043.

The amount of the dispersant in the traction fluid composition is preferably 1 to 10 weight percent, preferably 1.5 to 7 weight percent, and more preferably 2 to 3 weight percent.

The additive component for the traction fluid can also contain one or more detergents, which are normally salts, and specifically overbased salts. Overbased salts, or overbased materials, are single phase, homogeneous Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of 1.5, more preferably 3, more preferably 7, up to 40, preferably 25, more preferably 20.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents (mg KOH per gram of sample). Total base number is determined by titration of one gram of overbased material with 0.1 Normal hydrochloric acid solution using bromophenol blue as an indicator. The overbased materials of the present invention generally have a total base number of at least 20, preferably 100, morepreferably 200. The overbased material generally have a total base number up to 600, preferably 500, more preferably 400.

The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, xylene) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures thereof. Preferably, the acidic organic compounds are carboxylic acids or sulfonic acids with sulfonic and salicylic acids more preferred. Reference to acids, such as carboxylic, or sulfonic acids, is intended to include the acid-producing derivatives thereof such as anhydrides, lower alkyl esters, acyl halides, lactones and mixtures thereof unless otherwise specifically stated.

The carboxylic acids useful in making the overbased salts (A) of the invention can be aliphatic or aromatic, mono- or polycarboxylic acid or acid-producing compounds. These carboxylic acids include lower molecular weight carboxylic acids (e.g., carboxylic acids having up to 22 carbon atoms such as acids having 4 to 22 carbon atoms or tetrapropenyl-substituted succinic anhydride) as well as higher molecular weight carboxylic acids. The carboxylic acids of this invention are preferably oil-soluble. Usually, in order to provide the desired oil-solubility, the number of carbon atoms in the carboxylic acid should be at least 8, more preferably at least 18, more preferably at least 30, more preferably at least 50. Generally, these carboxylic acids do not contain more than 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, and tall oil acid. Monocarboxylic acids include isoaliphatic acids, often containing a principal chain having from 14 to 20 saturated, aliphatic carbon atoms and at least one but usually no more than four pendant acyclic lower alkyl groups. Specific examples of isoaliphatic acids include 10-methyltetradecanoic acid, 3-ethylhexadecanoic acid, and 8-methyloctadecanoic acid.

High molecular weight carboxylic acids can also be used in the present invention. These acids have a substituent group derived from a polyalkene. The polyalkene is characterized as containing at least 30 carbon atoms, preferably at least 35, more preferably at least 50, and up to 300 carbon atoms, preferably 200, more preferably 150. In one embodiment, the polyalkene is characterized by an $\overline{M}_n$ value of at least 500, generally 500 to 5000, preferably 800 to 2500. In another embodiment, $\overline{M}_n$ varies between 500 and 1200 or 1300. The higher molecular weight mono- and polycarboxylic acids suitable for use in making the overbased salts are well known in the art and have been described in detail, for example, in U.S. Pat. Nos. 3,024,237; 3,172,892; 3,219,666; 3,245,910; 3,271,310; 3,272,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133; British Patents 944, 136; 1,085,903; 1,162,436; and 1,440,219; and Canadian Patent 956,397.

Illustrative carboxylic acids include palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene ($\overline{M}_n$=200–1500, preferably 300–1000), polypropenyl-substituted succinic acid derived from a polypropene, ($\overline{M}_n$=200–1000, preferably 300–900), octadecyl-substituted adipic acid, chlorostearic acid, 9-methylstearic acid, dichlorostearic acid, stearyl-benzoic acid, eicosanyl-substituted naphthoic acid, dilauryl-decahydronaphthalene carboxylic acid, mixtures of any of these acids, their alkali and alkaline earth metal salts, and/or their anhydrides. A preferred group of aliphatic carboxylic acids includes the saturated and unsaturated higher fatty acids containing 12 to 30 carbon atoms. Illustrative of these acids are lauric acid, palmitic acid, oleic acid, linoleic acid, linoleic acid, oleostearic acid, stearic acid, myristic acid, and undecylenic acid, alpha-chlorostearic acid, and alphanitrolauric acid.

In another embodiment, the carboxylic acids are aromatic carboxylic acids. A group of useful aromatic carboxylic acids are those of the formula

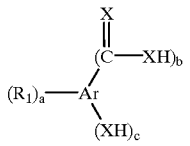

wherein $R_1$ is an aliphatic hydrocarbyl group of preferably 4 to 400 carbon atoms, a is a number of zero to 4, usually 1 or 2, Ar is an aromatic group, each X is independently sulfur or oxygen, preferably oxygen, b is a number of 1 to 4, usually 1 or 2, c is a number of zero to 4, usually 1 to 2, with the proviso that the sum of a, b and c does not exceed the number o f valences of Ar. Preferably, $R_1$ and a are such that there is an average of at least 8 aliphatic carbon atoms provided by the $R_1$ groups. Examples of aromatic carboxylic acids include substituted and non-substituted benzoic, phthalic and salicylic acids or anhydrides.

Examples of the aromatic groups that are useful herein include the polyvalent aromatic groups derived from benzene, naphthalene, and anthracene, preferably benzene. Specific examples of Ar groups include phenylenes and naphthylene, e.g., methylphenylenes, ethoxyphenylenes, isopropylphenylenes, hydroxyphenylenes, and dipropoxynaphthylenes.

Within this group of aromatic acids, a useful class of carboxylic acids are those of the formula

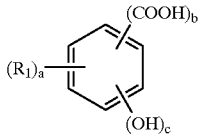

wherein $R_1$ is defined above, a is zero to 4, preferably 1 to 2; b is 1 to 4, preferably 1 to 2, c is zero to 4, preferably 1 to 2, and more preferably 1; with the proviso that the sum of a, b and c does not exceed 6. Preferably, $R_1$ and a are such that the acid molecules contain at least an average of 12 aliphatic carbon atoms in the aliphatic hydrocarbon substituents per acid molecule. Preferably, b and c are each one and the carboxylic acid is a salicylic acid.

The sulfonic acids useful in making the overbased salts of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulae: $R_2$—T—$(SO_3^-)_a$ and $R_3$—$(SO_3^-)_b$, wherein T is a cyclic nucleus such as, for example, benzene, naphthalene, anthracene, diphenylene oxide, diphenylene sulfide, or petroleum naphthenes; $R_2$ is an aliphatic group such as alkyl, alkenyl, alkoxy, or alkoxyalkyl; $(R_2)$+T contains a total of at least 15 carbon atoms; and $R_3$ is an aliphatic hydrocarbyl group containing at least 15 carbon atoms. Examples of $R_3$ are alkyl, alkenyl, alkoxyalkyl, and carboalkoxyalkyl. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, and disulfide. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didode-cylbenzene sulfonic acids, dinonylbenzene sulfonic acids, dilauryl betanaphthalene sulfonic acids, the sulfonic acid derived by the treatment of polybutene having a number average molecular weight ($\overline{M}_n$) in the range of 500 to 5000, preferably 800 to 2000, more preferably 1500 with chlorosulfonic acid, nitronaphthalene sulfonic acid, paraffin wax sulfonic acid, cetyl-cyclopentane sulfonic acid, lauryl-cyclohexane sulfonic acids, or polyethylenyl-substituted sulfonic acids derived from polyethylene ($\overline{M}_n$=300–1000, preferably 750). Normally the aliphatic groups will be alkyl and/or alkenyl groups such that the total number of aliphatic carbons is at least 8, preferably at least 12 up to 400 carbon atoms, preferably 250.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from 8 to 30 carbon atoms, preferably 12 to 30 carbon atoms, and advantageously about 24 carbon atoms. Such acids include di-isododecyl-benzene sulfonic acid, polybutenyl-substituted benzenesulfonic acid, polypropylenyl-substituted benzenesulfonic acids derived from polypropene having an $\overline{M}_n$=300–1000, preferably 500–700, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, and stearylnaphthalene sulfonic acid.

Dodecyl benzene "bottoms" sulfonic acids can also be used. These are the material leftover after the removal of dodecyl benzene sulfonic acids that are used for household detergents. These materials are generally alkyiated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The phosphorus-containing acids useful in making the basic metal salts (A) of the present invention include any phosphorus acids such as phosphoric acid or esters; and thiophosphorus acids or esters, including mono and dithiophosphorus acids or esters. Preferably, the phosphorus acids or esters contain at least one, preferably two, hydrdcarbyl groups containing from 1 to 50 carbon atoms, typically 1 to 30, preferably 3 to 18, more preferably 4 to 8.

In one embodiment, the phosphorus-containing acids are dithiophosphoric acids which are readily obtainable by the reaction of phosphorus pentasulfide ($P_2S_5$) and an alcohol or a phenol. The reaction involves mixing at a temperature of 20° C. to 200° C. four moles of alcohol or a phenol with one mole of phosphorus pentasulfide. The oxygen-containing analogs of these acids are conveniently prepared by treating the dithioic acid with water or steam which, in effect, replaces one or both of the sulfur atoms with oxygen.

In another embodiment, the phosphorus-containing acid is the reaction product of a polyalkene and phosphorus sulfide. Useful phosphorus sulfide-containing sources include phosphorus pentasulfide, phosphorus sesquisulfide, and phosphorus heptasulfide.

The phenols useful in making the basic metal salts (A) of the invention can be represented by the formula $(R_1)_a$—Ar—$(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to 4, more preferably 1 to 2. $R_1$ and a are preferably such that there is an average of at least 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl or anthranyl. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to 6 sulfur atoms, or a direct carbon-carbon linkage between the groups without any intervening atoms.

The acid to be overbased can be present as the acid itself, or it can be supplied in the form of an alternative source for such acid, that is, another material which will react under the conditions of the overbasing to produce the desired overbased product, possibly by means of forming the actual acid as an intermediate in situ. Thus, for example, suitable acid sources include the acids themselves as well as esters, amides, anhydrides, and salts of the acids. A preferred acid source is the vegetable oil based on the acid, e.g., palm oil, or coconut oil. The source can likewise be a hydrogenated vegetable oil, derived from an unsaturated vegetable oil. Vegetable oils are generally triglycerides. In the alkaline environment of the overbasing reaction, the oils are believed to be saponified to form the salt, which is then overbased, although the present invention is not intended to be limited by any such theoretical explanation.

The metal compounds useful in making the basic metal salts are generally any Group 1 or Group 2 metal compounds (CAS version of the Periodic Table of the Elements). The Group 1 metals of the metal compound include Group 1a alkali metals (e.g., sodium, potassium, lithium) as well as Group 1b metals such as copper. The Group 1 metals are preferably sodium, potassium, lithium and copper, more preferably sodium or potassium, and more preferably sodium. The Group 2 metals of the metal base include the Group 2a alkaline earth metals (e.g., magnesium, calcium, barium) as well as the Group 2b metals such as zinc or cadmium. Preferably the Group 2 metals are magnesium, calcium, barium, or zinc, preferably magnesium or calcium, more preferably calcium. Generally the metal compounds are delivered as metal salts. The anionic portion of the salt can be, e.g., hydroxide, oxide, carbonate, borate, or nitrate.

An acidic gas is employed to accomplish the formation of the overbased metal salt. The acidic gas is preferably carbon dioxide or sulfur dioxide, and is most preferably carbon dioxide.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic and phenolic promoters, which are preferred. The alcoholic promoters include the alkanols of one to twelve carbon atoms such as methanol, ethanol, amyl alcohol, octanol, isopropanol, and mixtures of these. Phenolic promoters include a variety of hydroxy-substituted benzenes and naphthalenes a particularly useful class of phenols are the alkylated phenols of the type listed in U.S. Pat. No. 2,777,874, e.g., heptylphenols, octylphenols, and nonylphenols. Mixtures of various promoters are sometimes used.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186, 3,384,585; 3,365,396; 3,320,162; 3,318,809; 3,488,284; and 3,629,109.

The amount of the overbased material, that is, the detergent, is preferably 0.05 to 5 percent by weight of the composition, more preferably 0.05 to 3 percent, 0.1 to 1.5 percent, or most preferably 0.2 to 1 percent by weight.

Preferably both a dispersant and a detergent are included in the composition; preferably a succinimide dispersant and a calcium overbased sulfonate detergent.

The compositions of the present invention can also contain a polymeric viscosity index modifier, preferably in limited amounts, that is, up to 10 percent by weight of the composition. Preferably the amount of this component is 0 to 1 percent by weight, and in one embodiment the traction fluids are substantially free from polymeric viscosity index modifiers.

Polymeric viscosity index modifiers (VMs) are extremely well known in the art and most are commercially available. Hydrocarbon VMs include polybutenes, poly(ethylene/propylene) copolymers, and hydrogenated polymers of styrene with butadiene or isoprene. Ester VMs include esters of styrene/maleic anhydride polymers, esters of styrene/maleic anhydride/acrylate terpolymers, and polymethacrylates. The acrylates are available from RohMax and from The Lubrizol Corporation; polybutenes from Ethyl Corporation and Lubrizol; ethylene/propylene copolymers from Exxon and Texaco; hydrogenated polystyrene/isoprene polymers from Shell; styrene/maleic esters from Lubrizol, and hydrogenated styrene/butadiene polymers from BASF.

Preferred VMs include acrylate- or methacrylate-containing copolymers or copolymers of styrene and an ester of an unsaturated carboxylic acid such as styrene/maleic ester (typically prepared by esterification of a styrene/maleic anhydride copolymer). Preferably the viscosity modifier is a polymethacrylate viscosity modifier. Polymethacrylate viscosity modifiers are prepared from mixtures of methacrylate monomers having different alkyl groups. The alkyl groups may be either straight chain or branched chain groups containing from 1 to 18 carbon atoms. When a small amount of a nitrogen-containing monomer is copolymerized with alkyl methacrylates, dispersancy properties are also incorporated into the product. Thus, such a product has the multiple function of viscosity modification, pour point depressancy and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. It is preferred that the viscosity modifier of the present invention is a dispersant viscosity modifier.

In one embodiment a dispersant viscosity modifier is prepared by polymerizing 57.5 parts methyl methacrylate, 12.7 parts butyl methacrylate, 226.5 parts each of $C_{9-11}$ methacrylate and $C_{12-15}$ methacrylate, 114.8 parts $C_{16-18}$ methacrylate and 11.7 parts N-(3-(dimethylamino)propyl) methacrylamide in a staged addition process. Details of the preparation of these and related polymers are found in European Patent Application 750,031, published Dec. 27, 1996.

The copolymers described above typically have a weight average molecular weight ($\overline{M}_w$) of 10,000 to 500,000, more often 30,000 to 250,000, frequently 20,000 to 100,000 and polydispersity values ($\overline{M}_w/\overline{M}_n$) of 1.2 to 5. Molecular weights of polymers are determined using well-known methods described in the literature.

Another optional component of the traction fluids of the present invention is a phosphorus acid, a phosphorus acid salt, a phosphorus ester, or mixtures thereof. The phosphorus acid or ester can be of the formula $(R^1X)(R^2X)P(X)_nX_mR^3$ or a salt thereof, where each X is independently an oxygen atom or a sulfur atom, n is 0 or 1, m is 0 or 1, m+n is 1 or 2, and $R^1$, $R^2$, and $R^3$ are hydrogen or hydrocarbyl groups, and preferably at least one of $R^1$, $R^2$, or $R^3$ is hydrogen. This component thus includes phosphorous and phosphoric acids, thiophosphorous and thiophosphoric acids, as well as phosphite esters, phosphate esters, thiophosphite esters, and thiophosphate esters. It is noted that certain of these materials can exist in tautomeric forms, and that all such tautomers are intended to be encompassed by the above formula and included within the present invention. For example, phosphorous acid and certain phosphite esters can be written in at least two ways:

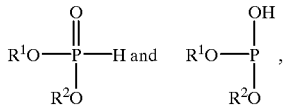

differing merely by the placement of the hydrogen. Each of these structures is intended to be encompassed by the present invention.

The phosphorus-containing acids can be at least one phosphate, phosphonate, phosphinate or phosphine oxide. These pentavalent phosphorus derivatives can be represented by the formula

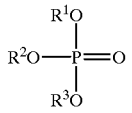

wherein $R^1$, $R^2$ and $R^3$ are as defined above. The phosphorus-containing acid can be at least one phosphite, phosphonite, phosphinite or phosphine. These trivalent phosphorus derivatives can be represented by the formula

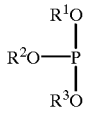

wherein $R^1$, $R^2$ and $R^3$ are defined as above. Generally, the total number of carbon atoms in $R^1$, $R^2$ and $R^3$ is at least 8, and in one embodiment at least 12, and in one embodiment at least 16. Examples of useful $R^1$, $R^2$ and $R^3$ groups include hydrogen, t-butyl, isobutyl, amyl, isooctyl, decyl, dodecyl, oleyl, $C_{18}$ alkyl, eicosyl, 2-pentenyl, dodecenyl, phenyl, naphtliyl, alkylphenyl, alkylnaphthyl, phenylalkyl, naphthylalkyl, alkylphenylalkyl, and alkylnaphthylalkyl groups.

In another embodiment, the phosphorus acid or ester is characterized by at least one direct carbon-to-phosphorus linkage such as those prepared by the treatment of an olefin polymer, such as one or more of the above polyalkenes (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

It is preferred that at least two of the X atoms in the above structure are oxygen, so that the structure will be $(R^1O)(R^2O)P(X)_nX_mR^3$, and more preferably $(R^1O)(R^2O)P(X)_nX_mH$. This structure can correspond, for example, to phosphoric acid when $R^1$, $R^2$, and $R^3$ are hydrogen. Phosphoric acid exists as the acid itself, $H_3PO_4$ and other forms equivalent thereto such as pyrophosphoric acid and anhydrides of phosphoric acid, including 85% phosphoric acid (aqueous), which is the commonly available commercial grade material. The formula can also correspond to a mono- or dialkyl hydrogen phosphite such as dibutyl hydrogen phosphite (a phosphite ester) when one or both of $R^1$ and $R^2$ are alkyl, respectively and $R^3$ is hydrogen, or a trialkyl phosphite ester when each of $R^1$, $R^2$, and $R^3$ is alkyl; in each case where n is zero, m is 1, and the remaining X is O. The structure will correspond to phosphoric acid or a related material when n and m are each 1; for example, it can be a phosphate ester such as a mono-, di- or trialkyl monothiophosphate when one of the X atoms is sulfur and one, two, or three of $R_6$, $R_7$, and $R_8$ are alkyl, respectively.

Phosphoric acid and phosphorus acid are well-known items of commerce. Thiophosphoric acids and thiophosphorous acids are likewise well known and are prepared by reaction of phosphorus compounds with elemental sulfur or other sulfur sources. Processes for preparing thiophosphorus acids are reported in detail in *Organic Phosphorus Compounds*, Vol. 5, pages 110–111, G. M. Kosolapoff et al., 1973.

Salts of the above phosphorus acids are well known. Salts include ammonium and amine salts as well as metal salts. Zinc salts, such as zinc dialkyldithiophosphates, are useful in certain applications.

The amount of the above phosphorus acid, salt, or ester in the traction fluid of the present invention is preferably an amount sufficient to provide at least 0.01 percent by weight of phosphorus to the fluids (calculated as P), preferably 0.01 to 0.1 percent, and more preferably 0.03 to 0.06 or 0.05 percent by weight.

Another optional, but preferred, species in the traction fluids of the present invention is one or more friction modifiers. Friction modifiers include alkoxylated fatty amines, borated fatty epoxides, fatty phosphites, fatty epoxides, fatty amines, borated alkoxylated fatty amines, metal salts of fatty acids, fatty acid amides, glycerol esters, borated glycerol esters, and fatty imidazolines.

As one preferred example of a friction modifier, zinc salts of fatty acids are well known materials. Fatty acids are generally hydrocarbon-based carboxylic acids, both synthetic and naturally occurring, preferably aliphatic acids, although acids containing aromatic functionality are also included. Occasional heteroatom substitution can be permitted in the hydrocarbyl portion of the fatty acid, consistent with the definition of "hydrocarbyl," below. Preferably the acid contains 14 to 30 carbon atoms, more preferably 16–24 carbon atoms, and preferably about 18 carbon atoms. The acid can be straight chain (e.g. stearic) or branched (e.g., isostearic). The acid can be saturated or it can contain olefinic unsaturation. A preferred acid is oleic acid, and the correspondingly preferred salt is zinc oleate, a commercially available material, the preparation of which is well known and is within the abilities of the person skilled in the art.

The zinc salt can be a neutral salt, that is, in which one equivalent of zinc is reacted with one equivalent of acid such as oleic acid. Alternatively, the zinc salt can be a slightly basic salt, in which one equivalent of a zinc base is reacted with somewhat less than one equivalent of acid. An example of such a material is a slightly basic zinc oleate, that is, $Zn_4Oleate_6O_1$.

Alkyl-substituted imidazolines are also well known friction modifying materials. They can generally be formed by the cyclic condensation of a carboxylic acid with a 1,2 diaminoethane compound. They generally have the structure

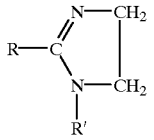

where R is an alkyl group and $R^1$ is a hydrocarbyl group or a substituted hydrocarbyl group, including $—(CH_2CH_2NH)_n—H$ groups. Among the numerous suitable carboxylic acids useful in preparing the imidazoline are oleic acid, stearic acid, isostearic acid, tall oil acids, and other acids derived from natural and synthetic sources. Specially preferred carboxylic acids are those containing 12 to 24 carbon atoms including the 18 carbon acids such as oleic acid, stearic acid, and isostearic acid. Among suitable 1,2 diaminoethane compounds are compounds of the general structure $R—NH—C_2H_4—NH_2$, where R is a hydrocarbyl group or a substituted hydrocarbyl group (e.g., hydroxyhydrocarbyl or aminohydrocarbyl). A preferred diamine is N-hydroxyethyl-1,2-diaminoethane, $HOC_2H_4NHC_2H_4NH_2$.

A preferred alkyl-substituted imidazoline is 1-hydroxyethyl-2-heptadecenyl imidazoline.

Another type of friction modifier includes borated epoxides, which are described in detail in U.S. Pat. No. 4,584,115, and are generally prepared by reacting an epoxide, preferably a hydrocarbyl epoxide, with boric acid or boron trioxide. The epoxide can be expressed by the general formula

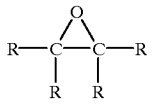

wherein each R is independently hydrogen or a hydrocarbyl group containing 8 to 30 carbon atoms, at least one of which is hydrocarbyl. Also included are materials in which any two of the R groups together with the atoms to which they are attached, for a cyclic group, which can be alicyclic or heterocyclic. Preferably one R is a hydrocarbyl group of 10 to 18 carbon atoms and the remaining R groups are hydrogen. More preferably the hydrocarbyl group is an alkyl group. The epoxides can be commercial mixtures of $C_{14-16}$ or $C_{14-18}$ epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemicals. Alternatively this material can be a reactive equivalent of an epoxide. By the term "reactive equivalent of an epoxide" is meant a material which can react with a boronating agent (described below) in the same or a similar manner as can an epoxide to give the same or similar products. An example of a reactive equivalent of an epoxide is a diol. Another example of a reactive equivalent to epoxides is the halohydrins. Other equivalents will be apparent to those skilled in the art. Other reactive equivalents include materials having vicinal dihydroxy groups which are reacted with certain blocking reagents. The borated compounds are prepared by blending the boron compound and the epoxide and heating them at a suitable temperature, typically 80° to 250° C., until the desired reaction has occurred. Boronating agents include the various forms of boric acid (including metaboric acid, HBO2, orthoboric acid, $H_3BO_3$, and tetraboric acid, $H_2B_4O_7$), boric oxide, boron trioxide, and alkyl borates of the formula $(RO)_xB(OH)_y$ wherein X is 1 to 3 and y is 0 to 2, the sum of x and y being 3, and where R is an alkyl group containing 1 to 6 carbon atoms. The molar ratio of the boronating agent to the epoxide or reactive equivalent thereof is generally 4:1 to 1:4. Ratios of 1:1 to 1:3 are preferred, with 1:2 being an especially preferred ratio. An inert liquid can be used in performing the reaction. The liquid may be, for example, toluene, xylene, or dimethylformamide. Water is formed and is typically distilled off during the reaction. Alkaline reagents can be used to catalyze the reaction. A preferred borated epoxide is the borated epoxide of a predominantly 16 carbon olefin.

Other friction modifiers include diethoxylated long chain amines such as N,N-bis-(2-hydroxyethyl)-tallowamine. Certain phosphorus-containing materials, described above, can also serve as friction modifiers, in particular, dialkylphosphites having alkyl groups of 12 to 24 carbon atoms.

The amount of friction modifier or modifiers is preferably 0.01 to 2 percent by weight of the traction fluid composition. More preferably it is 0.05 to 1.2 percent, and most preferably 0.1 to 1 percent by weight.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocar-bon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Samples are prepared in a base oil containing a fluidity modifier and an additive package. In Examples 1–12 the identity and amounts of components in the additive package is are follows:

| | |
|---|---|
| Overbased Ca sulfonate detergents | 1.07 percent by weight |
| Overbased Ca salicylate detergent | 0.19 percent by weight |
| Succinimide dispersant | 2.36 percent by weight |
| Succinimide dispersants, borated and/or sulfurized | 0.94 percent by weight |
| Phosphoric acid (85%) | 0.04 percent by weight |
| Dialkyl hydrogen phosphite | 0.19 percent by weight |
| Imidazoline and alkyl phosphite friction modifiers | 0.12 percent by weight |
| Borated fatty epoxide | 0.19 percent by weight |
| Fatty amine | 0.02 percent by weight |
| Dialkyl dimercaptothiadiazole | 0.03 percent by weight |
| Amine and/or sulfur containing antioxidants | 0.84 percent by weight |
| Seal swell agent | 0.57 percent by weight |
| Silicone and fluorosilicone antifoam agents | 0.04 percent by weight |
| Diluent oil | 0.63 percent by weight |

Each of the preceding individual components contains the conventional amount of diluent, if any, normally present in the commercial material.

Compositions are prepared containing the above-identified additives in the amounts shown (percent by weight), in a composition as shown below. The low temperature viscosity of each composition is also reported. Where multiple samples are prepared and tested, multiple results are given:

| Example: | 1 | 2 | 3 | 4* | 5 | 6 | 7* | 8 | 9 | 10* | 11 | 12 |
|---|---|---|---|---|---|---|---|---|---|---|---|---|
| Hydrogenated linear dimer of α-Me Styrene | 0 | 0 | 0 | 0 | 41.7 | 44.0 | 46.4 | 83.4 | 88.1 | 92.7 | 62.6 | 40.4 |
| Low m. w. hydrogenated polybutene[a] | 83.4 | 83.4 | 88.1 | 92.7 | 41.7 | 44.0 | 46.4 | 0 | 0 | 0 | 20.9 | 40.4 |
| 40 N naphthenic oil[b] | 9.3 | 9.3[c] | 4.6 | 0 | 9.3 | 4.6 | 0 | 9.3 | 4.6 | 0 | 9.3 | 9.0 |
| Polybutene viscosity improver | 0 | 0 | 0 | 0 | 0 | 0 | 0 | 0 | 0 | 0 | 0 | 3 |
| Additive package (above) | 7.3 | 7.3 | 7.3 | 7.3 | 7.3 | 7.3 | 7.3 | 7.3 | 7.3 | 7.3 | 7.3 | 7.3 |

-continued

| Example: | 1 | 2 | 3 | 4* | 5 | 6 | 7* | 8 | 9 | 10* | 11 | 12 |
|---|---|---|---|---|---|---|---|---|---|---|---|---|
| Brookfield viscosity, Pa · s (ASTM D2983) | | | | | | | | | | | | |
| −30° C. | 13.4<br>13.0 | 11.2 | 17.4<br>16.8 | 22.5<br>21.5 | 13.2<br>13.6 | 16.8 | 22.0 | 17.8<br>18.4 | 24.0 | 34.0<br>34.0 | 15.2 | 21.5 |
| −40° C. | 82<br>77 | 67 | 106<br>104 | 134<br>120 | 87<br>87 | 118 | 164 | 158<br>152 | 224 | 312<br>300 | 112 | 120 |
| Kinematic viscosity (ASTM D445) ($10^6$ $m^2$/sec [cSt]) | | | | | | | | | | | | |
| 40° C. | 27.2<br>27.2 | 26.0 | 30.4<br>30.4 | 34.0<br>30.2 | 22.1<br>22.1 | 24.2 | 26.6 | 19.5<br>19.5 | 21.3 | 23.3<br>23.3 | 20.6 | 30.2 |
| 100° C. | 5.1<br>4.67 | 4.61 | 4.98<br>4.99 | 5.30<br>4.7 | 4.14<br>4.2 | 4.34 | 4.55 | 3.75<br>3.77 | 3.92 | 4.13<br>4.12 | 4.0 | 4.7 |
| Traction Coefficient Slide/roll | | | | | | | | | | | | |
| 2.5% | .059<br>.061 | .059 | .059<br>.063 | .062<br>.065 | .071<br>.069 | .070 | .074 | .082<br>.079 | n.d. | n.d. | .076 | .065 |
| 5.0% | .065<br>.066 | .065 | .065<br>.068 | .068<br>.071 | .076<br>.074 | .075 | .080 | .086<br>.084 | n.d. | n.d. | .081 | .071 |
| 7.5% | .068<br>.070 | .06 | .069<br>.071 | .072<br>.074 | .078<br>.077 | .078 | .082 | .087<br>.086 | n.d. | n.d. | .083 | .074 |
| 10.0% | .070<br>.072 | .07 | .070<br>.073 | .074<br>.075 | .080<br>.079 | .080 | .083 | .088<br>.087 | n.d. | n.d. | .084 | .075 |

*Comparative
[a]: Panalane ™ L-14E
[b]: Diamond Shamrock 40 Pale ™ except as noted
[c]: Calumet Hydrocal ™ 38
n. d.: Not determined The traction coefficient is determined generally as disclosed in U.S. Pat. No. 3,975,278 and is a well-known measurement. More particularly for the present testing, a MTM traction measurement system from PCS Instruments is used. The test includes evaluating the fluid behavior in an EHD contact formed between a polished 19.1 mm (¾ inch) steel ball and a 46 mm diameter steel disk, each independently driven to produce a sliding/rolling contact, lubricated with the test specimen (each sample being about 30 g). Testing is carried out at a Hertz contact pressure of 1.25 GPa. The temperature of the test oil at the inlet of the contact is continuously measured and controlled to 100° C., and the system given sufficient time to thermally stabilize. Rolling speed is maintained at 2.5 m/s. A slide to roll ratio continuously varying from 0% to 10% is achieved by changing the surface speeds of both specimens simultaneously. Traction force is continuously measured during each test, and traction coefficient is calculated therefrom. Traction coefficient, $f_t$, is defined by $$f_t = F_t / P_n$$

where $F_t$ is the measured tangential or tractive force exerted between the members and $P_n$ is the normal load or contact force between the members.

Examples 13.

| | |
|---|---|
| Overbased Ca sulfonate detergent | 0.23% |
| Succinimide dispersant | 4.0% |
| Dialkyl hydrogen phosphite | 0.11% |
| phosphoric acid (85%, aqueous) | 0.1% |
| Sulfur-containing succinic ester/ amide corrosion inhibitor | 1.0% |
| Amine and/or sulfur-containing antioxidants | 1.1% |
| Alkyl-substituted thiadiazole | 0.03% |
| Borated fatty epoxide | 0.2% |
| Seal swell agent | 0.4% |
| Alkenyl imidazoline friction modifier | 0.05% |
| Alkoxylated fatty amine | 0.01% |
| Silicone and fluorosilicone antifoam agents | 0.04% |
| Diluent oil | 0.68% |

Each of the preceding individual components contains the conventional amount of diluent, if any, normally present in the commercial material.

A traction fluid is prepared with and 41.4% hydrogenated linear dimer of α-methyl styrene, 41.4% low molecular weight hydrogenated polybutene (as above), 9.2% 40 N naphthenic oil, and the above additive package.

The viscosity of the fluid thus prepared is measured, as in Examples 1–12. The Brookfield viscosity at −30° C. is 20.0 Pa·s and at −40° C. is 138 Pa·s. The kinematic viscosity is $28.5\times10^{-6}$ $m^2$/s at 40° C. and $5.0\times10^{-6}$ $m^2$/s at 100° C.

Examples 14–18

The following compositions are prepared and tested (amounts given in percent by weight, inclusive of conventional diluent oil):

| | Example: | | | | |
|---|---|---|---|---|---|
| | 14 | 15 | 16 | 17 | 18 |
| Base oil: | | | | | |
| Hydrogenated linear dimer of α-methyl styrene | 79 | 0 | 84.95 | 83.4 | 40 |
| Low molecular weight hydrogenated polybutene | 0 | 79 | 0 | 92 | 42.5 |
| Fluidity modifier: | | | | | |
| 40 Neutral naphthenic oil | 20 | 1 | 0 | 0 | 5 |
| Low m.w. poly-α-olefin (Ethylflo ™ 162) | 0 | 0 | 15 | 3 | 5 |
| Detergent: | | | | | |
| Ca overbased sulfonate | 1 | 10 | 0 | 0 | 5 |
| Dispersant: | | | | | |
| Mannich dispersant | 0 | 0 | 0.05 | 5 | 2.5 |

The examples immediately above may, optionally, contain other additive components used in transmission fluids including succinimide dispersants, phosphorus acids and esters, seal swell agents, friction modifiers, antiwear agents, corrosion inhibitors, antioxidants, and foam inhibitors.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A traction fluid useful in automotive power transmitting equipment, comprising:

(a) a major amount of a base fluid comprising a predominantly linear hydrogenated dimer of alpha-alkylstyrene;

(b) a low-temperature viscosity control agent selected from the group consisting of oligomers or polymers of linear alpha olefins of at least 8 carbon atoms, naphthenic oils, synthetic ester oils, polyether oils, and mixtures thereof, in an amount sufficient to reduce the viscosity at −40° C. of said traction fluid; and (c) an additive selected from the group consisting of dispersants, detergents, and mixtures thereof, in an amount sufficient to improve the clutch friction durability performance of said traction fluid.

2. The traction fluid of claim 1 wherein the base fluid has a viscosity of greater than about 2.5 cSt at 100° C. and the low-temperature viscosity control agent has a viscosity of up to about 2.5 cSt at 100° C.

3. The traction fluid of claim 1 wherein said traction fluid exhibits a viscosity at −40° C. of less than about 100 Pa·s.

4. The traction fluid of claim 1 wherein said traction fluid exhibits a viscosity at −40° C. of about 5 to about 70 Pa·s.

5. The traction fluid of claim 1 wherein components (a) and (b) are hydrogenated materials.

6. The traction fluid of claim 5 wherein components (a) and (b) are each substantially free from carbon-carbon unsaturation.

7. The traction fluid of claim 1 wherein said additive (c) includes a dispersant.

8. The traction fluid of claim 7 wherein the dispersant is a succinimide dispersant.

9. The traction fluid of claim 7 wherein the amount of said dispersant is about 1 to about 10 percent by weight of the composition.

10. The traction fluid of claim 1 wherein said additive (c) includes a detergent.

11. The traction fluid of claim 10 wherein said detergent is an overbased sulfonate detergent.

12. The traction fluid of claim 11 wherein said overbased sulfonate detergent is a calcium overbased sulfonate detergent.

13. The traction fluid of claim 10 wherein the amount of said detergent is about 0.05 to about 5 percent by weight of the composition.

14. The traction fluid of claim 1 wherein said additive (c) includes a succinimide dispersant and a calcium overbased sulfonate detergent.

15. The traction fluid of claim 1 wherein said fluid contains up to about 10 percent by weight of a polymeric viscosity index modifier.

16. The traction fluid of claim 15 wherein said fluid contains 0 to about 1 percent by weight of a polymeric viscosity index modifier.

17. The traction fluid of claim 16 wherein said fluid is substantially free from polymeric viscosity index modifiers.

18. The traction fluid of claim 1 further comprising (d) at least one phosphorus-containing acid, salt, or ester in an amount to contribute about 0.005 to about 0.06% phosphorus to the traction fluid.

19. The traction fluid of claim 18 wherein said phosphorus-containing acid, salt, or ester comprises dibutyl hydrogen phosphite.

20. The traction fluid of claim 1 further comprising (e) at least one friction modifier.

21. The traction fluid of claim 20 wherein the amount of friction modifier is about 0.01 to about 2 percent by weight.

22. The traction fluid of claim 1 wherein said base fluid comprises a polymer of isobutylene having a molecular weight of about 200 to about 700.

23. The composition of claim 1 wherein said base fluid contains a major proportion of compound represented by the general structure

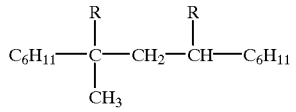

wherein, each R is an alkyl group of 1 to 4 carbon atoms.

24. The traction fluid of claim 1 wherein said low-temperature viscosity control agent has a viscosity of less than $2.5\times10^{-6}$ $m^2/s$ at 100° C.

25. The traction fluid of claim 1 wherein said low-temperature viscosity control agent comprises an oligomer or polymer of linear alpha olefins having 8 to about 16 carbon atoms, said oligomer or polymer having a molecular weight of about 250 to about 400.

26. The traction fluid of claim 25 wherein said alpha olefins contain about 10 to about 12 carbon atoms.

27. The traction fluid of claim 1 wherein said low temperature viscosity control agent comprises a naphthenic oil.

28. The traction fluid of claim 1 wherein said low temperature viscosity control agent comprises a synthetic ester oil selected from the group consisting of:

(i) esters of polyhydroxy compounds and predominantly monocarboxylic acylating agents, (ii) esters of predominantly monohydroxy compounds and polycarboxylic acylating agents, and (iii) esters of monohydroxy compounds and monocarboxylic acylating agents, (iv) mixtures of (i) through (iii).

29. The traction fluid of claim 1 wherein said low temperature viscosity control agent comprises a polyether oil selected from the group consisting of polyethylene oxides, polypropylene oxides, polybutylene oxides, and mixtures thereof.

30. A traction fluid prepared by admixing the components of claim 1.

31. A method of lubricating a power transmission apparatus, comprising employing therein the traction fluid of claim 1.

32. The method of claim 31 wherein said power transmission apparatus drive is an automatic transmission.

33. The method of claim 32 wherein said automatic transmission is a continuously variable transmission.

34. The method of claim 31 wherein said power transmission apparatus is a tracton/drive.

35. The method of claim 31 wherein said power transmission apparatus is a push-belt continuously variable transmission.

36. The traction fluid of claim 1 wherein said traction fluid exhibits a viscosity at −40° C. of less than or equal to 224 Pa·s.

37. The traction fluid of claim 1 wherein said traction fluid exhibits a viscosity at −30° C. of 11.2 to 24 Pa·s.

* * * * *